US007580012B2

(12) United States Patent
Kim et al.

(10) Patent No.: US 7,580,012 B2
(45) Date of Patent: Aug. 25, 2009

(54) PIXEL AND LIGHT EMITTING DISPLAY USING THE SAME

(75) Inventors: Yang Wan Kim, Seoul (KR); Won Kyu Kwak, Gyeonggi-do (KR)

(73) Assignee: Samsung Mobile Display Co., Ltd., Gyeonggi-do (KR)

( * ) Notice: Subject to any disclaimer, the term of this patent is extended or adjusted under 35 U.S.C. 154(b) by 671 days.

(21) Appl. No.: 11/283,529

(22) Filed: Nov. 18, 2005

(65) Prior Publication Data

US 2006/0132054 A1 Jun. 22, 2006

(30) Foreign Application Priority Data

Nov. 22, 2004 (KR) ..... 10-2004-0095985

(51) Int. Cl.
*G09G 3/32* (2006.01)

(52) U.S. Cl. ..... 345/76; 315/169.3

(58) Field of Classification Search ..... 345/60–100
See application file for complete search history.

(56) References Cited

U.S. PATENT DOCUMENTS

| | | | | |
|---|---|---|---|---|
| 6,229,506 | B1 * | 5/2001 | Dawson et al. | 345/82 |
| 6,373,454 | B1 * | 4/2002 | Knapp et al. | 345/76 |
| 6,525,704 | B1 * | 2/2003 | Kondo et al. | 345/78 |
| 6,556,177 | B1 * | 4/2003 | Katayama et al. | 345/76 |
| 6,777,710 | B1 | 8/2004 | Koyama | |
| 6,858,991 | B2 * | 2/2005 | Miyazawa | 315/169.3 |
| 6,919,871 | B2 * | 7/2005 | Kwon | 345/92 |
| 7,508,365 | B2 * | 3/2009 | Kim | 345/76 |
| 2003/0179164 | A1 * | 9/2003 | Shin et al. | 345/76 |
| 2003/0227262 | A1 * | 12/2003 | Kwon | 315/169.3 |
| 2004/0183758 | A1 * | 9/2004 | Chen et al. | 345/76 |

FOREIGN PATENT DOCUMENTS

| | | | |
|---|---|---|---|
| TW | 594638 A | * | 6/2004 |
| WO | WO 2004061812 A1 | * | 7/2004 |

OTHER PUBLICATIONS

Lin, H. C., Diode Operation of a Transistor in Functional Blocks, May 1963, IEEE Transactions on Electron Devices, vol. 10, issue 3, pp. 189-194.*

* cited by examiner

*Primary Examiner*—Richard Hjerpe
*Assistant Examiner*—Dorothy Webb
(74) *Attorney, Agent, or Firm*—Knobbe Martens Olson & Bear LLP

(57) ABSTRACT

A pixel capable of displaying a uniform image in spite of process variation is disclosed. The pixel includes an organic light emitting diode display (OLED), a first transistor for controlling current that flows from a first power source to the OLED in response to a data signal, a second transistor connected between an nth (n is a natural number) scan line and a data line to supply the data signal on the data line to the first transistor when a scan signal is supplied to the nth scan line, a storage capacitor connected to the gate terminal of the first transistor to store the voltage corresponding to the data signal, and a third transistor formed to have a conductivity type different from the conductivity type of the first and/or second transistors and connected to the (n−1)th scan line so as to be turned on when the scan signal is supplied to the (n−1)th scan line. Therefore, it is possible to prevent leakage current from being generated due to process variation and to thus display an image with desired brightness.

20 Claims, 6 Drawing Sheets

1990369

101305

PIXEL AND LIGHT EMITTING DISPLAY USING THE SAME

CROSS-REFERENCE TO RELATED APPLICATIONS

This application claims the benefit of Korean Patent Application No. 2004-95985, filed on Nov. 22, 2004, in the Korean Intellectual Property Office, the disclosure of which is incorporated herein by reference.

BACKGROUND

1. Field of the Invention

The present invention relates to a pixel and a light emitting display using the same, and more particularly to a pixel capable of displaying a uniform image in spite of deviation in processes and a light emitting display using the same.

2. Discussion of Related Technology

Recently, various flat panel displays of advantageously reduced weight and volume compared to cathode ray tubes (CRT) have been developed. Flat panel displays include liquid crystal displays (LCD), field emission displays (FED), plasma display panels (PDP), and light emitting displays.

Among the flat panel displays, the light emitting displays have spontaneous emission devices that emit light by recombination of electrons and holes to display images. The light emitting displays have high response speed and are driven by low power consumption.

FIG. 1 is a circuit diagram illustrating a pixel of a conventional light emitting display.

Referring to FIG. 1, the pixel 4 of the conventional light emitting display includes a pixel circuit 2 connected to an organic light emitting diode display (OLED), a data line Dm, and a scan line Sn to emit light from the OLED.

The anode electrode of the OLED is connected to the pixel circuit 2 and the cathode electrode of the OLED is connected to a second power source ELVSS. The OLED generates light according to the current supplied by the pixel circuit 2.

The pixel circuit 2 includes a second transistor M2 connected between a first power source ELVDD and the OLED, a first transistor M1 connected among the second transistor M2, the data line Dm, and the scan line Sn, and a storage capacitor C connected between the gate terminal and a first terminal of the second transistor M2.

The gate terminal of the first transistor M1 is connected to the scan line Sn and a first terminal of the first transistor M1 is connected to the data line Dm. The second terminal of the first transistor M1 is connected to one terminal of the storage capacitor C. Here, the first terminal is set as one of a source terminal and a drain terminal and the second terminal is set as the other terminal different from the first terminal. For example, when the first terminal is set as the source terminal, the second terminal is set as the drain terminal. The first transistor M1 is turned on when a scan signal is supplied by the scan line Sn to supply a data signal supplied by the data line Dm to the storage capacitor C. At this time, the voltage corresponding to the data signal is charged in the storage capacitor C.

The gate terminal of the second transistor M2 is connected to one terminal of the storage capacitor C and the first terminal of the second transistor M2 is connected to the other terminal of the storage capacitor C and the first power source ELVDD. The second terminal of the second transistor M2 is connected to the anode electrode of the OLED. The second transistor M2 controls the amount of current that flows from the second power source ELVDD to the OLED corresponding to the voltage value stored in the storage capacitor C. Thusly configured, the OLED generates light with brightness corresponding to the amount of current supplied by the second transistor M2.

However, the above-described conventional pixel 4, does not display images with uniform brightness across various pixels. Actually, the threshold voltage of the second transistor M2 varies with each pixel due to deviation in processing. Therefore, although the same data signal is applied, light with different brightness is generated by the various pixels.

SUMMARY OF CERTAIN INVENTIVE EMBODIMENTS

Accordingly, an aspect of certain embodiments is to provide a pixel capable of displaying a uniform brightness in spite of deviation in processes and a light emitting display using the same.

One embodiment has a pixel including an organic light emitting diode (OLED), a first transistor configured to control current from a first power source to the OLED according to a data signal, a second transistor configured to selectively connect the data signal to the first transistor according to a first scan signal on an nth (where n is a natural number) scan line, a capacitor connected to the gate terminal of the first transistor configured to store a voltage corresponding to the data signal, and a third transistor having a conductivity type different from the conductivity types of at least one of the first and second transistors. The third transistor is connected to an (n−1)th scan line and configured to be turned on when a second scan signal is supplied to the (n−1)th scan line.

Another embodiment has a pixel including an OLED, a second transistor having a first terminal connected to a data line and having a gate terminal connected to an nth (n is a natural number) scan line, a first transistor having a first terminal connected to the second terminal of the second transistor, a third transistor having a first terminal and a gate terminal each connected to the gate terminal of the first transistor and having a second terminal connected to an (n−1)th scan line, a fourth transistor connected between the gate terminal and the second terminal of the first transistor and having a gate terminal connected to the nth scan line, a fifth transistor connected between a first power source and the first terminal of the first transistor and having a gate terminal connected to an emission control line, and a sixth transistor connected between the second terminal of the first transistor and the OLED and having a gate terminal connected to the emission control line. The third transistor is formed to have a conductivity type different from the conductivity type of the first transistor.

Another embodiment has a light emitting display including a data driver configured to supply a plurality of data signals to a plurality of data lines, a scan driver configured to sequentially supply a plurality of scan signals to a plurality of scan lines and to supply an off voltage to the scan lines during periods when the scan signals are not supplied, where the off voltage has a value greater than the value of the voltage of the data signals, and an image display including a plurality of pixels connected to one or more of the data lines and to one or more of the scan lines. Each of the pixels includes one or more transistors and a first of the one or more transistors is of a first conductivity type and a second of the one or more transistors is of a second conductivity type. A third of the one or more transistors is connected to an nth (n is a natural number) scan line and a fourth of the one or more transistors is connected to an (n−1)th scan line.

Another embodiment has a pixel including means for emitting light according to a current provided, means for controlling current from a first power source to the means for emitting according to a data signal, means for selectively connecting the data signal to the means for controlling according to a first scan signal on an nth (where n is a natural number) scan line, means for storing a voltage connected to the means for controlling, where the voltage corresponds to the data signal, and means for selectively conducting having a conductivity type different from the conductivity types of at least one of the means for controlling and the means for selectively connecting, the means for selectively conducting being connected to an (n−1)th scan line and configured to be turned on when a second scan signal is supplied to the (n−1)th scan line.

BRIEF DESCRIPTION OF THE DRAWINGS

These and/or other aspects and advantages will become apparent and more readily appreciated from the following description of the certain embodiments, taken in conjunction with the accompanying drawings of which.

DETAILED DESCRIPTION OF CERTAIN INVENTIVE EMBODIMENTS

Hereinafter, embodiments will be described with reference to the accompanying drawings, FIGS. 2 to 7B.

Figure 1:
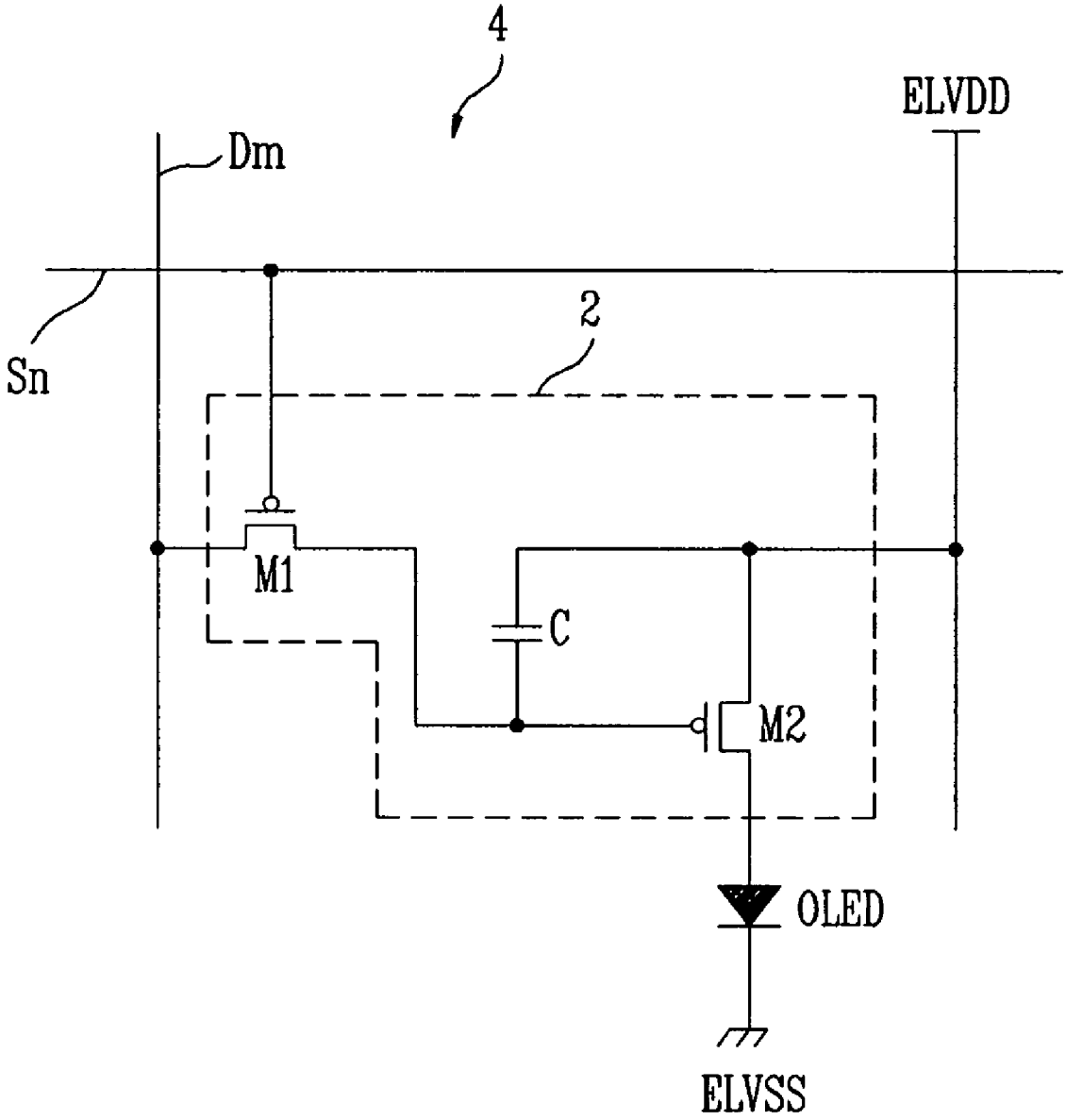
FIG. 1 (PRIOR ART)
FIG. 1 is a circuit diagram illustrating a conventional pixel.
Figure 2:
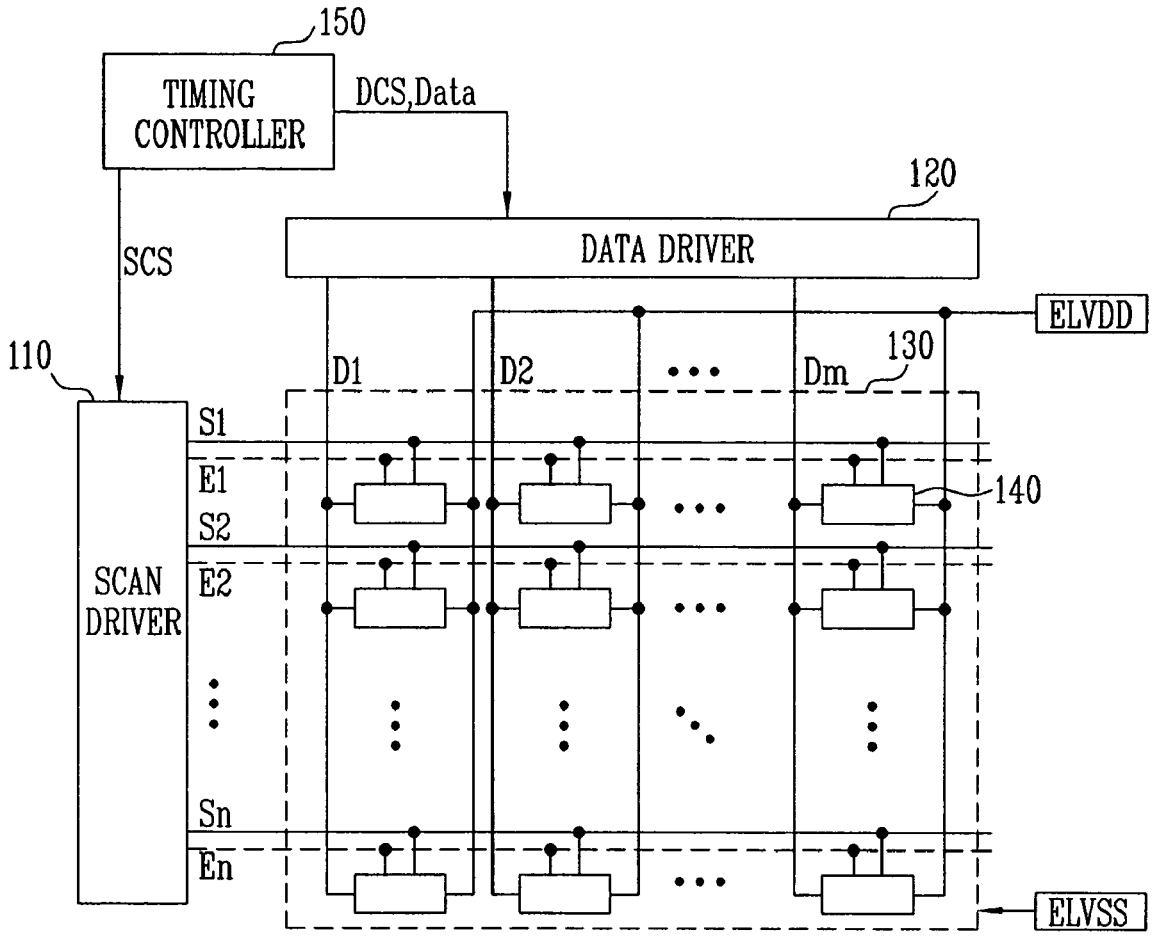
FIG. 2 illustrates a light emitting display according to an embodiment of the present invention.

FIG. 2 illustrates a light emitting display according to an embodiment.

Referring to FIG. 2, the light emitting display according to the embodiment includes an image display 130 including pixels 140 formed in the regions partitioned by scan lines S1 to Sn and data lines D1 to Dm. The display also includes a scan driver 110 for driving the scan lines S1 to Sn, a data driver 120 for driving the data lines D1 to Dm, and a timing controller 150 for controlling the scan driver 110 and the data driver 120.

The scan driver 110 receives scan driving control signals SCS from the timing controller 150. The scan driver 110, in response to the scan driving control signals SCS, sequentially generates scan signals on the scan lines S1 to Sn. Also, the scan driver 110 sequentially generates emission control signals in response to the scan driving control signals SCS on emission control lines E1 to En. In some embodiments the width of the emission control signals is equal to or wider than the width of the scan signals.

The data driver 120 receives data driving control signals DCS from the timing controller 150. The data driver 120, in response to the data driving control signals DCS, generates data signals to the data lines D1 to Dm so as to be synchronized with the scan signals.

The timing controller 150 generates the data driving control signals DCS and the scan driving control signals SCS according to the synchronizing signals supplied from the outside. The data driving control signals DCS generated by the timing controller 150 are supplied to the data driver 120 and the scan driving control signals SCS generated by the timing controller 150 are supplied to the scan driver 110. The timing controller 150 also supplies data Data supplied from the outside to the data driver 120.

The image display 130 receives the first power source ELVDD and the second power source ELVSS from the outside to supply the first power source ELVDD and the second power source ELVSS to the pixels 140, respectively. The pixels 140 that receive the first power source ELVDD and the second power source ELVSS generate light according to the data signals. The emission times of the pixels 140 are controlled by the emission control signals E1 to En.

Figure 3:
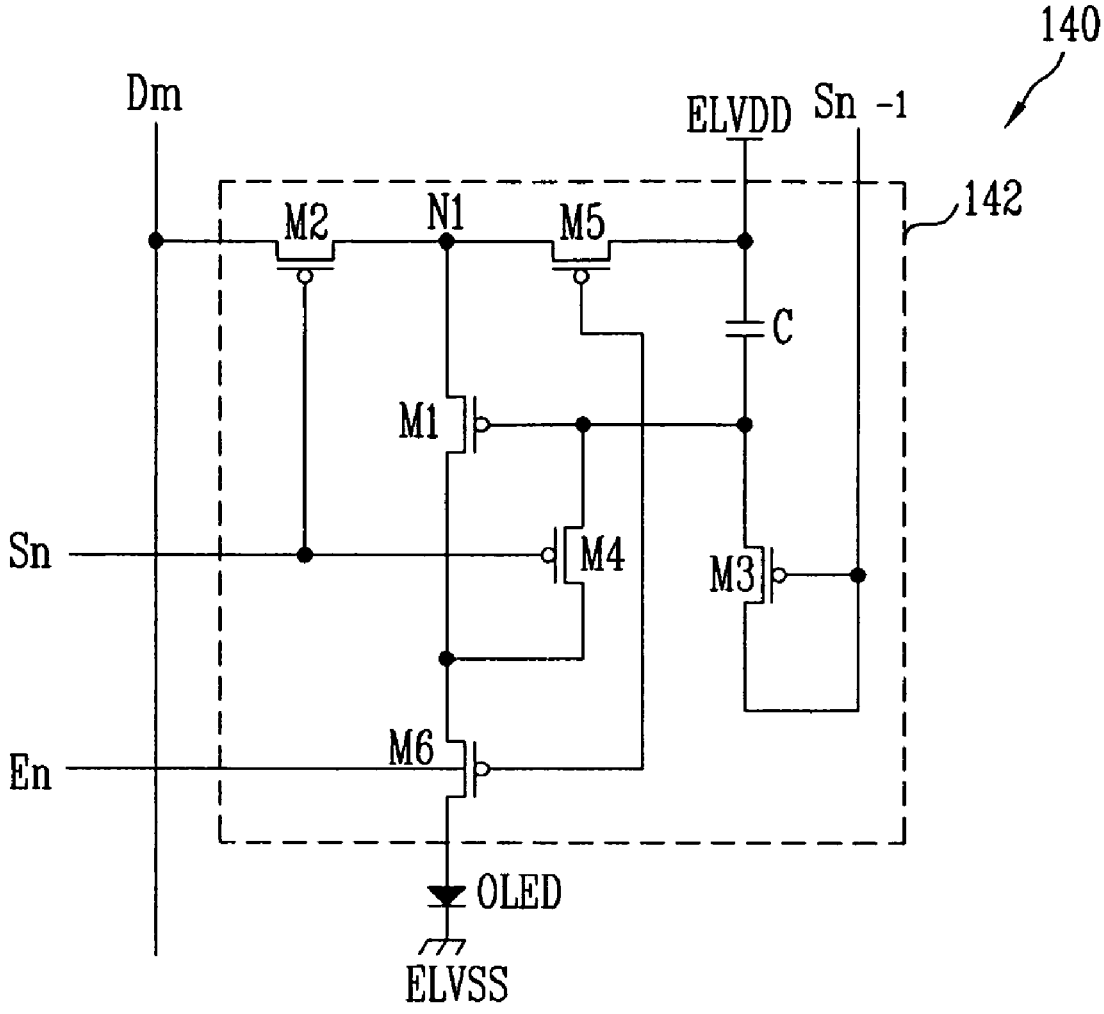
FIG. 3 is a circuit diagram illustrating a pixel according to an embodiment of the present invention.

FIG. 3 is a circuit diagram illustrating a pixel according to a first embodiment of the present invention.

Referring to FIG. 3, pixel 140 according to one embodiment includes a pixel circuit 142 connected to the OLED, a data line Dm, a scan line Sn, and an emission control line En.

The anode electrode of the OLED is connected to the pixel circuit 142 and the cathode electrode of the OLED is connected to the second power source ELVSS. The second power source ELVSS may have a voltage lower than the voltage of the first power source ELVDD, for example, a ground voltage. The OLED generates light according to the current supplied by the pixel circuit 142. The OLED may be formed of organic material.

The pixel circuit 142 includes a storage capacitor C and a third transistor M3 connected between the first power source ELVDD and the (n−1)th scan line Sn-1, a second transistor M2 and a fifth transistor M5 connected between the first power source ELVDD and the data line Dm, a sixth transistor M6 connected between the OLED and the emission control line En, a first transistor M1 connected between the sixth transistor M6 and a first node N1, and a fourth transistor M4 connected between the gate terminal and the second terminal of the first transistor M1.

The first terminal of the first transistor M1 is connected to the first node N1 and the second terminal of the first transistor M1 is connected to the first terminal of the sixth transistor M6. The gate terminal of the first transistor M1 is connected to the storage capacitor C. The first transistor M1 supplies the current corresponding to the voltage charged in the storage capacitor C to the OLED.

The second terminal of the fourth transistor M4 is connected to the gate terminal of the first transistor M1 and the first terminal of the fourth transistor M4 is connected to the second terminal of the first transistor M1. The gate terminal of the fourth transistor M4 is connected to the nth scan line Sn. The fourth transistor M4 is turned on when the scan signal is supplied to the nth scan line Sn. Therefore, electric current flows through the first transistor M1 so that the first transistor M1 performs as a diode.

The first terminal of the second transistor M2 is connected to the data line Dm and the second terminal of the second transistor M2 is connected to the first node N1. The gate terminal of the second transistor M2 is connected to the nth scan line Sn. The second transistor M2 is turned on when the scan signal is supplied to the nth scan line Sn to supply the data signal supplied to the data line Dm to the first node N1.

The second terminal of the fifth transistor M5 is connected to the first node N1 and the first terminal of the fifth transistor M5 is connected to the first power source ELVDD. The gate terminal of the fifth transistor M5 is connected to the emission control line En. The fifth transistor M5 is turned on when the emission control signals are supplied so as to electrically connect the first power source ELVDD and the first node N1 to each other.

The first terminal of the sixth transistor M6 is connected to the second terminal of the first transistor M1 and the second terminal of the sixth transistor M6 is connected to the OLED. The gate terminal of the sixth transistor M6 is connected to the emission control line En. The sixth transistor M6 is turned on when the emission control signals are supplied so as to supply the current supplied by the first transistor M1 to the OLED.

The second terminal of the third transistor M3 is connected to the storage capacitor C and the gate terminal of the first transistor M1 and the first terminal and the gate terminal of the third transistor M3 are connected to the (n−1)th scan line Sn-1. The third transistor M3 is turned on when the scan signal is supplied to the (n−1)th scan line Sn-1 to initialize the voltage on the node shared by the storage capacitor C and the gate terminal of the first transistor M1.

The operations of the pixel 140 will be described in detail. First, the scan signal is supplied to the (n−1)th scan line Sn-1 so that the third transistor M3 is turned on. When the third transistor M3 is turned on, the storage capacitor C and the gate terminal of the first transistor M1 are connected to the (n−1)th scan line Sn-1. Therefore, the scan signal is supplied to the storage capacitor C and the gate terminal of the first transistor M1 so that the voltage on the node shared by the storage capacitor C and the gate terminal of the first transistor M1 is initialized. Here, the voltage of the scan signal is lower than the voltage of the data signal.

Then, the scan signal is supplied to the nth scan line Sn. When the scan signal is supplied to the nth scan line Sn, the second and fourth transistors M2 and M4 are turned on. When the second transistor M2 is turned on, the data signal supplied to the data line Dm is supplied to the first node N1 via the second transistor M2. At this time, since the voltage of the gate terminal of the first transistor M1 is initialized by the scan signal (that is, is set to be lower than the voltage of the data signal supplied to the first node N1), the first transistor M1 is turned on.

When the first transistor M1 is turned on, the data signal applied to the first node N1 is supplied to one side of the storage capacitor C via the first and fourth transistors M1 and M4. Here, since electric current flows through the first transistor M1 so that the first transistor M1 serves as a diode, the voltage corresponding to the data signal and the threshold voltage of the first transistor M1 is charged in the storage capacitor C.

After the voltage corresponding to the data signal and the threshold voltage of the first transistor M1 is charged in the storage capacitor C, supply of the emission control signals is stopped so that the fifth and sixth transistors M5 and M6 are turned on. When the fifth and sixth transistors M5 and M6 are turned on, a selectively conductive current path from the first power source ELVDD to the OLED is formed. The selectively conductive current path is conditioned on the data signal. Here, the state of the first transistor M1 corresponds to the voltage charged in the storage capacitor C. Accordingly, first transistor M1 acts as a selectively conductive switch, selectively conducting the current from the first power source ELVDD to the OLED where conductivity is based on the data.

According to the pixel 140 of one embodiment, because the voltage corresponding to the data signal and the threshold voltage of the first transistor M1 are charged in the storage capacitor C, the current through M1 and therefore the brightness of the OLED will not depend on the threshold voltage of transistor M1.

Figure 4A:
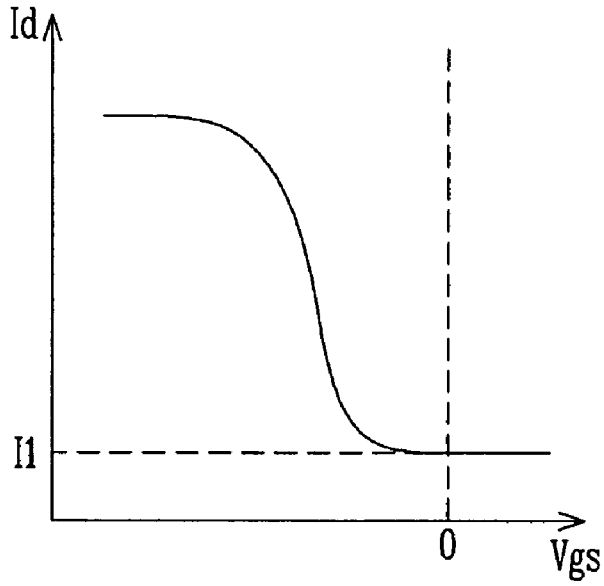
FIGS. 4A and 4B are plots illustrating the threshold voltage of the third transistor illustrated in FIG. 3.

However, the pixel 140 according to the present invention may not display an image of desired brightness due to leakage current caused by the third transistor M3. To be specific, the threshold voltage characteristic of the PMOS third transistor M3 is described as illustrated in FIG. 4A. In the graph of FIG. 4A, the Y axis represents current that flows to the drain terminal and the X axis represents voltage between the gate terminal and a the source terminal.

Figure 4B:
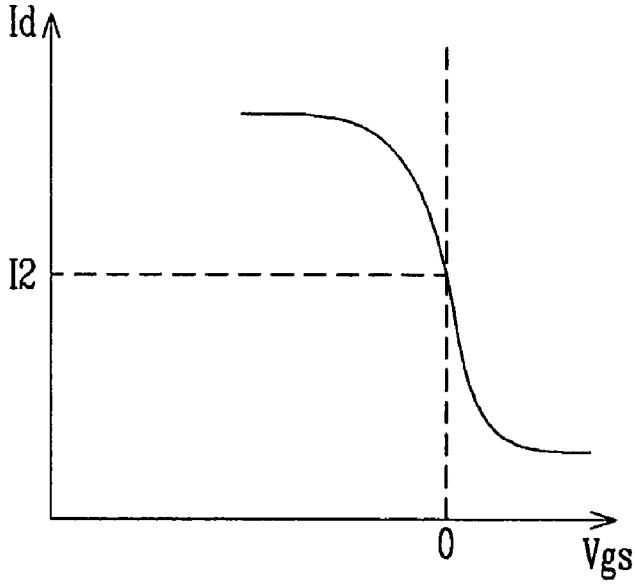

In FIG. 4A, when the third transistor M3 is turned off, that is, when no scan signal is supplied to the (n−1)th scan line Sn-1, the leakage current of first current I1 is generated. The leakage current I1 is sufficiently small that it will not affect picture quality. However, due to the influences of process conditions, as illustrated in FIG. 4B, the threshold voltage of the third transistor M3 may be shifted to the right. This is especially troublesome, as some manufacturing methods include operations so as to intentionally shift the threshold voltages to the right.

As illustrated in FIG. 4B, when the threshold voltage of the third transistor M3 is shifted on the right too much, the leakage current of I2, being higher than I1, is generated when the third transistor M3 is set to be turned off. When the high leakage current I2 is generated the brightness of the OLED is determined in part by the leakage current I2. As the amount of leakage current I2 will vary from pixel to pixel, the brightness will correspondingly vary.

Figure 5:
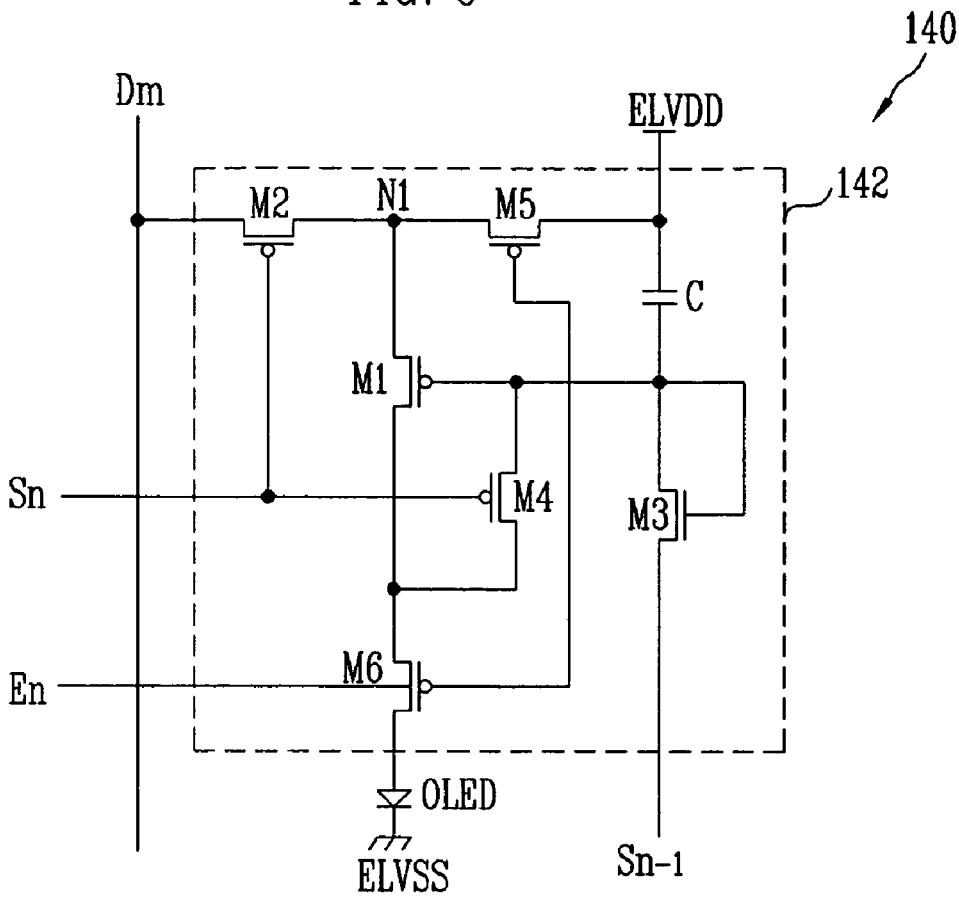
FIG. 5 is a circuit diagram illustrating a pixel according to a an embodiment of the present invention.

FIG. 5 is a circuit diagram illustrating a pixel according to another embodiment.

Referring to FIG. 5, pixel 140 includes a pixel circuit 142 connected to the OLED, a data line Dm, a scan line Sn, and an emission control line En to emit light from the OLED.

The anode electrode of the OLED is connected to the pixel circuit 142 and the cathode electrode of the OLED is connected to the second power source ELVSS. The second power source ELVSS may have a voltage lower than the voltage of the first power source ELVDD, for example, a ground voltage. The OLED generates light corresponding to the current supplied by the pixel circuit 142. The OLED is formed of organic material.

The pixel circuit 142 includes a storage capacitor C and a third transistor M3 connected between the gate of a first transistor M1 and the (n−1)th scan line Sn-1, a second transistor M2 and a fifth transistor M5 connected between the first power source ELVDD and the data line Dm, a sixth transistor M6 connected between the OLED and the emission control line En, the first transistor M1 connected between the sixth transistor M6 and a first node N1, and a fourth transistor M4 connected between the gate terminal and the second terminal of the first transistor M1.

The third transistor M3 is formed to have a conductivity type different from the conductivity types of the other transistors M1, M2, M3, M4, M5, and M6. For example, the third transistor M3 may be formed to be an NMOS type and the other transistors M1, M2, M3, M4, M5, and M6 may be formed to be PMOS types. Other types of transistors, such as NPN and PNP BJT's, and switching devices may also be used.

The first terminal of the first transistor M1 is connected to the first node N1 and the second terminal of the first transistor M1 is connected to the first terminal of the sixth transistor M6. The gate terminal of the first transistor M1 is connected to the storage capacitor C. The first transistor M1 supplies the current corresponding to the voltage charged in the storage capacitor C to the OLED.

The second terminal of the fourth transistor M4 is connected to the gate terminal of the first transistor M1 and the first terminal of the fourth transistor M4 is connected to the second terminal of the first transistor M1. The gate terminal of the fourth transistor M4 is connected to the nth scan line Sn. The fourth transistor M4 is turned on when the scan signal is supplied to the nth scan line Sn. Therefore, electric current flows through the first transistor M1 so that the first transistor M1 serves as a diode. That is, when the fourth transistor M4 is turned on, electric current flows through the first transistor M1 so that the first transistor M1 performs as a diode.

The first terminal of the second transistor M2 is connected to the data line Dm and the second terminal of the second transistor M2 is connected to the first node N1. The gate terminal of the second transistor M2 is connected to the nth scan line Sn. The second transistor M2 is turned on when the scan signal is supplied to the nth scan line Sn to supply the data signal on data line Dm to the first node N1.

The second terminal of the fifth transistor M5 is connected to the first node N1 and the first terminal of the fifth transistor M5 is connected to the first power source ELVDD. The gate terminal of the fifth transistor M5 is connected to the emission control line En. The fifth transistor M5 is turned on when the emission control signals are supplied so as to electrically connect the first power source ELVDD and the first node N1 to each other.

The first terminal of the sixth transistor M6 is connected to the second terminal of the first transistor M1 and the second terminal of the sixth transistor M6 is connected to the OLED. The gate terminal of the sixth transistor M6 is connected to the emission control line En. The sixth transistor M6 is turned on when the emission control signals are supplied so as to supply the current supplied by the first transistor M1 to the OLED.

The first terminal and the gate terminal of the third transistor M3 are connected to the storage capacitor C and the gate terminal of the first transistor M1 and the second terminal of the third transistor M3 is connected to the (n−1)th scan line Sn-1. That is, electric current flows through the third transistor M3 so that the third transistor M3 performs as a diode and that the third transistor M3 can be turned on when the scan signal is supplied to the (n−1)th scan line Sn-1. When the third transistor M3 is turned on, the voltage on the node shared by the storage capacitor C and the gate terminal of the first transistor M1 is initialized.

Figure 6:
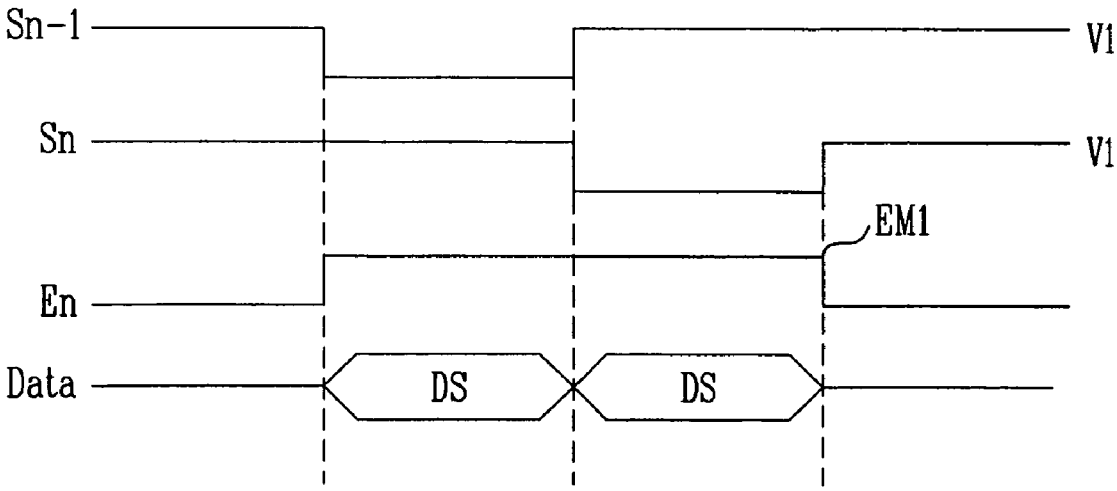
FIG. 6 is a signal diagram illustrating driving waveforms supplied to the pixel illustrated in FIG. 5.

FIG. 6 illustrates waveforms in order to describe the method of driving the pixel illustrated in FIG. 5.

The operations of the pixel 140 will be described in detail with reference to FIGS. 5 and 6. First, the scan signal is supplied to the (n−1)th scan line Sn-1 so that the third transistor M3 is turned on. This occurs while an off voltage V1 is supplied to the nth scan line Sn, such that second transistor M2 and fourth transistor M4 are turned off. The off voltage V1 is equal to or higher than the highest voltage of the data signal that can be supplied. When the third transistor M3 is turned on, the storage capacitor C and the gate terminal of the first transistor M1 are connected to the (n−1)th scan line Sn-1. Therefore, the scan signal is supplied to the storage capacitor C and the gate terminal of the first transistor M1 so that the voltage on the node shared by the storage capacitor C and the gate terminal of the first transistor M1 is initialized. The voltage of the scan signal is lower than the lowest voltage of the data signal that can be supplied by at least a threshold voltage of M1.

After the voltage on the node shared by the capacitor C and the first transistor M1 is initialized, the scan signal is supplied to the nth scan line Sn so that second transistor M2 and fourth transistor M4 are turned on. This occurs while the off voltage V1 is supplied to the (n−1)th scan line. When the second and fourth transistors M2 and M4 are turned on, the data signal DS on data line Dm is supplied to the first node N1 via the second transistor M2. Also, since the voltage of the gate terminal of the first transistor M1 is lower than the voltage of the data signal DS, the first transistor M1 is turned on.

When the first transistor M1 is turned on, the data signal applied to the first node N1 minus a threshold voltage of M1 is supplied to one side of the storage capacitor C via the first and fourth transistors M1 and M4. The threshold voltage drop occurs because M1 is performing as a diode.

In this addressing scheme, when the scan signal is supplied to the (n−1)th line to display the data for that line, the pixels in the nth line will be initialized as described above with the third transistor M3 of each pixel. Then, when the scan signal is supplied to the nth scan line Sn, the off voltage V1 is supplied to the (n−1)th scan line Sn-1.

After the voltage corresponding to the data signal and the threshold voltage of the first transistor M1 is charged in the storage capacitor C, the emission control signal EMI is supplied to the emission control line En so as to turn on the fifth and sixth transistors M5 and M6. A selectively conductive current path from the first power source ELVDD to the OLED is formed. The selectively conductive current path is conditioned on the data signal. Here, the state of the first transistor M1 corresponds to the voltage charged in the storage capacitor C. Accordingly, first transistor M1 acts as a selectively conductive switch, selectively conducting the current from the first power source ELVDD to the OLED where conductivity is based on the data.

According to the pixel 140 of FIG. 5, because the voltage corresponding to the data signal and the threshold voltage of the first transistor M1 are charged in the storage capacitor C, the current through M1 and therefore the brightness of the OLED will not depend on the threshold voltage of transistor M1. In some embodiments, the third transistor M3 is formed to be an NMOS type transistor. When the third transistor M3 is formed to be NMOS type, it is possible to display an image with desired brightness in spite of variation in processing because of the advantageous leakage characteristics of the NMOS transistor.

Figure 7A:
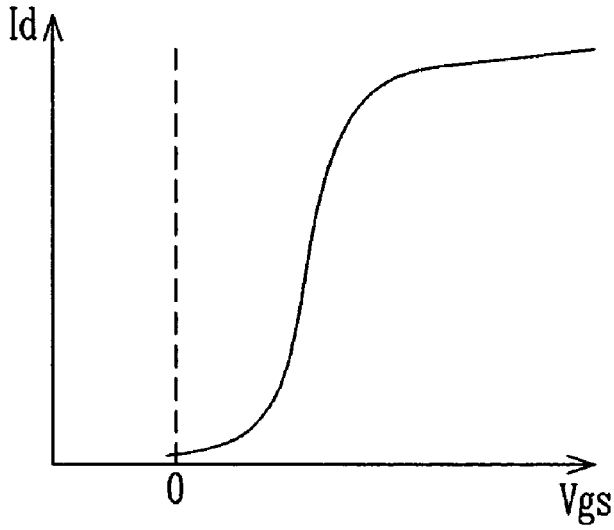
FIGS. 7A and 7B are plots illustrating the threshold voltage of the third transistor illustrated in FIG. 5.
Figure 7B:
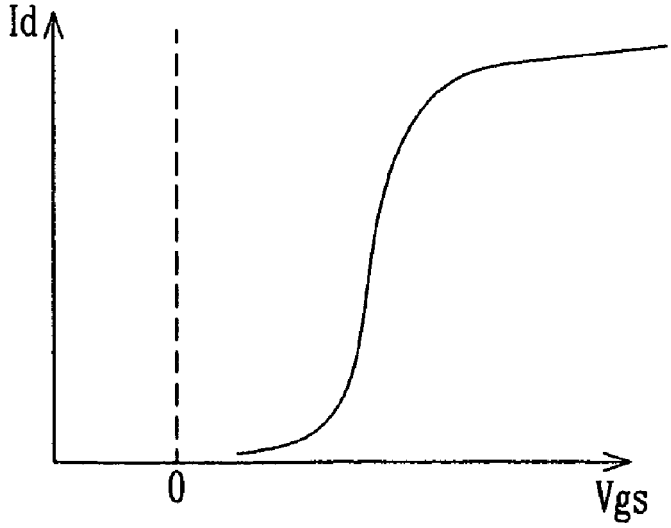

The threshold voltage characteristic of the third transistor M3 formed to be NMOS type is illustrated in FIG. 7A. In the graph of FIG. 7A, the Y axis represents current that flows to the drain terminal and the X axis represents voltage between the gate terminal and the source terminal. As illustrated in FIG. 7A, when the third transistor M3 is set to be turned off, no significant leakage current is generated. Even when the threshold voltage of the third transistor M3 is shifted to the right due to in processing, as illustrated in FIG. 7B, the leakage current of the third transistor M3 does not increase, and in fact decreases. That is, according to the pixel 140 FIG. 5, the third transistor M3 is formed to be NMOS type so that it is possible to prevent high leakage current from being generated because of process variation and to thus display an image with consistent brightness.

As described above, the brightness of a pixel can be independent of the voltage threshold of the driving transistors, which are sensitive to process variations. Also if the initialization transistor M3 is made to be of the opposite conductive type as the driving transistors, leakage can be substantially eliminated so that the brightness of the pixel is independent of leakage characteristics, which are also sensitive to process variations.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A pixel comprising:

an organic light emitting diode (OLED);

a first transistor configured to control current from a first power source to the OLED according to a data signal;

a second transistor configured to selectively connect the data signal to the first transistor according to a first scan signal on an nth (where n is a natural number) scan line;

a capacitor connected to the gate terminal of the first transistor configured to store a voltage corresponding to the data signal; and a third transistor having a conductivity type different from the conductivity types of at least one of the first and second transistors, the third transistor being diode connected to an (n−1)th scan line and configured to be turned on when a second scan signal is supplied to the (n−1)th scan line.

2. The pixel according to claim 1, wherein the conductivity type of at least one of the first and second transistors is PMOS, and the conductivity type of the third transistor is NMOS.

3. The pixel according to claim 1, wherein the third transistor, when on, is configured to supply the gate terminal of the first transistor and the capacitor with a voltage corresponding to the second scan signal.

4. The pixel according to claim 1, wherein the voltage of the scan signal is lower than the voltage of the data signal.

5. The pixel according to claim 1, wherein an off voltage is supplied to the second transistor when the scan signal is supplied to the (n−1)th scan line, and wherein the value of the off voltage is equal to or higher than the voltage of the data signal.

6. The pixel according to claim 1, further comprising a fourth transistor connected to the first transistor such that the first transistor performs as a diode when the scan signal is supplied to the nth scan line.

7. The pixel according to claim 6, further comprising an additional one or more transistors forming a selectively conductive current path from the first power source, through the first transistor, and to the OLED, the additional one or more transistors being connected to emission control lines.

8. The pixel according to claim 7, wherein the emission control lines are configured to carry emission control signals, and the additional one or more transistors are configured to conduct current according to the emission control signals.

9. The pixel according to claim 1, wherein the voltage corresponding to the data signal also corresponds to the voltage threshold of the first transistor.

10. The pixel according to claim 1, wherein the gate terminal of the first transistor is connected to the gate terminal and a first terminal of the third transistor.

11. The pixel according to claim 1, wherein the third transistor is configured to initialize a voltage based on the second scan signal.

12. A pixel comprising:

an OLED;

a second transistor having a first terminal connected to a data tine and having a gate terminal connected to an nth (n is a natural number) scan tine;

a first transistor having a first terminal connected to the second terminal of the second transistor;

a third transistor having a first terminal and a gate terminal each connected to the gate terminal of the first transistor and having a second terminal connected to an (n−1)th scan line;

a fourth transistor connected between the gate terminal and the second terminal of the first transistor and having a gate terminal connected to the nth scan line;

a fifth transistor connected between a first power source and the first terminal of the first transistor and having a gate terminal connected to an emission control line; and a sixth transistor connected between the second terminal of the first transistor and the OLED and having a gate terminal connected to the emission control line, wherein the third transistor is formed to have a conductivity type different from the conductivity type of the first transistor.

13. The pixel according to claim 12, wherein the conductivity type of the first transistor is PMOS, and wherein the conductivity type of the third transistor is NMOS.

14. A light emitting display comprising:

a data driver configured to supply a plurality of data signals to a plurality of data lines;

a scan driver configured to sequentially supply a plurality of scan signals to a plurality of scan lines and to supply an off voltage to the scan lines during periods when the scan signals are not supplied, wherein the off voltage has a value greater than the value of the voltage of the data signals; and an image display comprising a plurality of pixels connected to one or more of the data lines and to one or more of the scan lines, wherein each of the pixels comprises one or more transistors and a first of the one or more transistors is of a first conductivity type and a second of the one or more transistors is of a second conductivity type, and wherein a third of the one or more transistors is connected to an nth (n is a natural number) scan line and a fourth of the one or more transistors is diode connected to an (n−1)th scan line.

15. The display according to claim 14, wherein the first conductivity type is PMOS and the second conductivity type is NMOS.

16. The display according to claim 14, wherein each of the pixels comprises:

an OLED;

a first transistor configured to control current from a first power source to the OLED according to a data signal;

a second transistor configured to selectively connect the data signal to the first transistor according to a first scan signal on an nth (n is a natural number) scan line;

a capacitor connected to the gate terminal of the first transistor configured to store a voltage corresponding to the data signal; and a third transistor configured to have a conductivity type different from the conductivity types of at least one of the first and second transistors, the third transistor being connected to the (n−1)th scan line and configured to be turned on when a second scan signal is supplied to the (n−1)th scan line,

17. The display according to claim 16, wherein the conductivity type of at least one of the first and second transistors is PMOS, and wherein the conductivity type of the third transistor is NMOS.

18. The display according to claim 16, further comprising a fourth transistor connected to the first transistor such that current flows through the first transistor and such that the first transistor performs as a diode when the scan signal is supplied to the nth scan line.

19. The display according to claim 18, further comprising an additional one or more transistors forming a selectively conductive current path from the first power source, through the first transistor, and to the OLED, the additional one or more transistors being controlled by emission control lines.

20. The pixel according to claim 16, wherein the third transistor is configured to initialize a voltage based on the second scan signal.

* * * * *

UNITED STATES PATENT AND TRADEMARK OFFICE

CERTIFICATE OF CORRECTION

PATENT NO. : 7,580,012 B2
APPLICATION NO. : 11/283529
DATED : August 25, 2009
INVENTOR(S) : Kim et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 950 days.

Signed and Sealed this

Fourteenth Day of September, 2010

David J. Kappos

David J. Kappos
*Director of the United States Patent and Trademark Office*